US010688539B2

(12) United States Patent
Zheng et al.

(10) Patent No.: US 10,688,539 B2
(45) Date of Patent: Jun. 23, 2020

(54) CLEANING DEVICE AND CLEANING METHOD IMPLEMENTED BY THE SAME

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Xianfeng Zheng, Beijing (CN); Yangkun Jing, Beijing (CN); Sangwoog Kim, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 260 days.

(21) Appl. No.: 14/802,798

(22) Filed: Jul. 17, 2015

(65) Prior Publication Data

US 2016/0129487 A1 May 12, 2016

(30) Foreign Application Priority Data

Nov. 11, 2014 (CN) ..... 2014 1 0632530

(51) Int. Cl.
*B08B 9/043* (2006.01)
*B08B 9/045* (2006.01)

(52) U.S. Cl.
CPC ..... *B08B 9/0436* (2013.01); *B08B 9/045* (2013.01)

(58) Field of Classification Search
USPC ..... 15/22.1, 104.04, 104.05
See application file for complete search history.

(56) References Cited

U.S. PATENT DOCUMENTS 4,501,322 A * 2/1985 Martin ..... E21B 37/02 15/104.2
6,276,018 B1 * 8/2001 Leiman ..... B08B 9/045 15/104.095

(Continued)

FOREIGN PATENT DOCUMENTS

CN 1585676 A 2/2005
CN 101864803 A 10/2010

(Continued)

OTHER PUBLICATIONS

Office Action dated Aug. 25, 2016 issued in corresponding Chinese Application No. 201410632530.8.

*Primary Examiner* — Rita P Adhlakha
(74) *Attorney, Agent, or Firm* — Nath, Goldberg & Meyer; Joshua B. Goldberg

(57) ABSTRACT

The present disclosure provides a cleaning device and a cleaning method implemented by the cleaning device. The cleaning device is used for cleaning a water supply pipe, and comprises: a cleaning unit, which is at least partially provided inside the water supply pipe; a control unit, which is connected to the cleaning unit, for detecting whether volume of a foreign body left on an inner wall of the water supply pipe exceeds a preset volume, when it is determined that the volume of the foreign body left on the inner wall of the water supply pipe exceeds the preset volume, controlling the cleaning unit to clean the water supply pipe so as to remove the foreign body on the inner wall of the water supply pipe. In this disclosure, foreign bodies left on the inner wall of the pipe can be removed automatically, thus normal water supply can be ensured.

11 Claims, 2 Drawing Sheets

(56) References Cited

U.S. PATENT DOCUMENTS

| | | | | |
|---|---|---|---|---|
| 9,339,854 | B2 | 5/2016 | Chee et al. | |
| 9,615,506 | B2 * | 4/2017 | Ruppert | A01C 7/102 |

FOREIGN PATENT DOCUMENTS

| | | | |
|---|---|---|---|
| CN | 103736699 | A | 4/2014 |
| CN | 203803872 | U | 9/2014 |
| JP | 2000-37672 | A | 2/2000 |

* cited by examiner

CLEANING DEVICE AND CLEANING METHOD IMPLEMENTED BY THE SAME

FIELD OF THE INVENTION

The present invention relates to the field of liquid crystal display manufacturing technology, and particularly to a cleaning device and a cleaning method implemented by the cleaning device.

BACKGROUND OF THE INVENTION

At present, liquid crystal displays (LCDs) have become mainstream products in flat display devices due to their characteristics, such as small volume, low power consumption and no radiation. A display panel is a main component in a liquid crystal display device and generally comprises an array substrate and a color filter substrate which are assembled to form a cell.

In the liquid crystal display, in order to obtain a more uniform brightness and a high contrast, the liquid crystal molecules in the display panel are required to maintain specific orientation when no electric field is applied, thus it is necessary to form alignment films (P1) on surfaces of the array substrate and the color filter substrate to be aligned which face each other. The alignment films are usually transferred onto the array substrate and the color filter substrate through a transfer print by an alignment film printing machine. In order to ensure the quality of alignment film printing and quality of the alignment film itself, generally, before the alignment film is printed, it is required to clean the array substrate and the color filter substrate, only by cleaning the incoming substrates (for example, the array substrate and the color filter substrate), perfect print quality and effect of the printed alignment films can be ensured.

Current cleaning of incoming substrate is mainly performed by using lotion and supplying water through a pipe, which has been used for a long time, the pipe is likely left with foreign bodies and impurities (such as scale, lotion particles and other dirt in water) on the inner wall thereof, and thus blocks consisting of the foreign bodied and the impurities may be formed on the inner wall of the pipe, which seriously affects normal supply of water, therefore, normal clean of the incoming substrate may be affected. However, at present, there is no better measure to remove the foreign bodies and impurities inside the pipe.

SUMMARY OF THE INVENTION

In view of the above problem in the prior art, the present invention provides a cleaning device and a cleaning method implemented by the cleaning device, wherein by providing the cleaning device with a cleaning unit and a control unit, the foreign bodies and impurities left on the inner wall of the pipe can be removed automatically, thus normal water supply can be ensured.

The present invention provides a cleaning device for cleaning a water supply pipe, comprising:

a cleaning unit, which is at least partially provided inside the water supply pipe; and a control unit, which is connected to the cleaning unit, for detecting whether volume of a foreign body left on an inner wall of the water supply pipe exceeds a preset volume, and when it is determined that the volume of the foreign body left on the inner wall of the water supply pipe exceeds the preset volume, controlling the cleaning unit to clean the water supply pipe so as to remove the foreign body left on the inner wall of the water supply pipe.

Preferably, the cleaning unit comprises a support portion including a support rod and a cleaning portion including a cleaning head, a nozzle and a sprinkling pipe, and wherein the cleaning head is provided inside the water supply pipe, the nozzle is provided on the cleaning head, one end of the sprinkling pipe is connected to the nozzle, and water in the sprinkling pipe can be ejected onto the cleaning head through the nozzle; and one end of the support rod is connected to the cleaning head so as to support the cleaning head, and the sprinkling pipe is arranged along a length direction of the support rod.

Preferably, the cleaning head is impeller-shaped, the nozzle is positioned at the center of the cleaning head, and water ejected from the nozzle can be ejected onto blades of the impeller-shaped cleaning head to impel the cleaning head to rotate around its center.

Preferably, at least part of the blades of the cleaning head are provided with needle-shaped teeth at end faces thereof, and wherein the needle-shaped teeth can smash the foreign body left on the inner wall of the water supply pipe.

Preferably, the cleaning portion further includes a driving mechanism, which is connected to the other end of the sprinkling pipe for injecting water into the sprinkling pipe at a set pressure.

Preferably, the support rod can be stretched or contracted.

Preferably, the sprinkling pipe is a flexible pipe.

Preferably, the control unit includes a collection portion and a control portion, the collection portion is connected to the control portion, and the control portion is connected to the driving mechanism; the collection portion is used to collect an actual water flow rate and/or an actual water pressure inside the water supply pipe, and the control portion is used to judge whether the volume of the foreign body left on the inner wall of the water supply pipe exceeds the preset volume according to the actual water flow rate and/or the actual water pressure, and transmit a cleaning control signal to the driving mechanism when the control portion determines that the volume of the foreign body left on the inner wall of the water supply pipe exceeds the preset volume; and the driving mechanism is used to inject water into the sprinkling pipe under the control of the cleaning control signal.

Preferably, the collection portion includes a flow rate sensor and/or a pressure sensor provided on the wall of the water supply pipe, and wherein the flow rate sensor is used to collect the actual water flow rate inside the water supply pipe, and the pressure sensor is used to collect the actual water pressure inside the water supply pipe.

Preferably, the control portion includes a storage module, a comparison module and a control module, and wherein the storage module is connected to the comparison module, the comparison module is connected to the control module, and the control module is connected to the driving mechanism;

the storage module is used to store a normal water flow rate and a normal water pressure inside the water supply pipe;

the comparison module is used to compare the actual water flow rate with the normal water flow rate and/or compare the actual water pressure with the normal water pressure to judge whether the actual water flow rate exceeds the normal water flow rate and/or the actual water pressure exceeds the normal water pressure, and transmit a judgment result to the control module; and the control module is used to control the driving mechanism to inject water into the sprinkling pipe through the cleaning control signal when the actual water flow rate exceeds the normal water flow rate and/or the actual water pressure exceeds the normal water pressure.

The present invention further provides a cleaning method implemented by the above cleaning device, comprising steps of:

detecting, by the control unit, whether volume of a foreign body left on an inner wall of the water supply pipe exceeds a preset volume; and cleaning the water supply pipe so as to remove the foreign body on the inner wall of the water supply pipe, by the cleaning device under the control of the control unit, when the control unit determines that the volume of the foreign body left on an inner wall of the water supply pipe exceeds the preset volume.

Preferably, the step of detecting, by the control unit, whether volume of a foreign body left on an inner wall of the water supply pipe exceeds a preset volume further comprises steps of:

collecting, by the control unit, an actual water flow rate and an actual water pressure inside the water supply pipe; and comparing, by the control unit, the actual water flow rate with a prestored normal water flow rate and the actual water pressure with a prestored normal water pressure to judge whether the actual water flow rate exceeds the normal water flow rate and the actual water pressure exceeds the normal water pressure, wherein, if the actual water flow rate exceeds the normal water flow rate and the actual water pressure exceeds the normal water pressure, the control unit determines that the volume of the foreign body left on the inner wall of the water supply pipe exceeds the preset volume.

Preferably, the step of detecting, by the control unit, whether volume of a foreign body left on an inner wall of the water supply pipe exceeds a preset volume further comprises steps of:

collecting, by the control unit, an actual water flow rate inside the water supply pipe; and comparing, by the control unit, the actual water flow rate with a prestored normal water flow rate to judge whether the actual water flow rate exceeds the normal water flow rate, wherein, if the actual water flow rate exceeds the normal water flow rate, the control unit determines that the volume of the foreign body left on the inner wall of the water supply pipe exceeds the preset volume.

Preferably, the step of detecting, by the control unit, whether volume of a foreign body left on an inner wall of the water supply pipe exceeds a preset volume further comprises steps of:

collecting, by the control unit, an actual water pressure inside the water supply pipe; and comparing, by the control unit, the actual water pressure with a prestored normal water pressure to judge whether the actual water pressure exceeds the normal water pressure, wherein, if the actual water pressure exceeds the normal water pressure, the control unit determines that the volume of the foreign body left on the inner wall of the water supply pipe exceeds the preset volume.

Advantages of the present invention are as follows: by providing the cleaning device of the present invention with a cleaning unit and a control unit, the foreign bodies left on the inner wall of the water supply pipe can be removed automatically, thus normal water supply of the water supply pipe can be ensured.

DESCRIPTION OF REFERENCE NUMERALS

1-water supply pipe; 2-cleaning unit; 21-support rod; 22-cleaning head; 221-needle-shaped tooth; 23-nozzle; 24-sprinkling pipe; 25-driving mechanism; 3-control unit; 31-collection portion; 311-flow rate sensor; 312-pressure sensor; 32-control portion; 321-storage module; 322-comparison module; and 323-control module.

DETAILED DESCRIPTION OF THE EMBODIMENTS

In order to make persons skilled in the art better understand solutions of the present invention, the cleaning device and the cleaning method implemented by the cleaning device in the present invention will be described in detail below in conjunction with the drawings and embodiments.

First Embodiment

Figure 1:
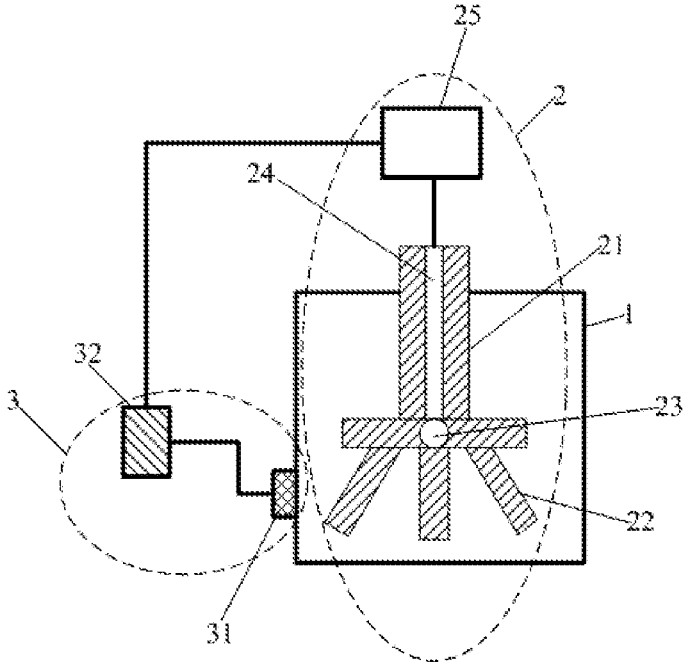
FIG. 1 is a structural diagram of a cleaning device in a first embodiment of the present invention.

This embodiment provides a cleaning device, as shown in FIG. 1, for removing a foreign body left on an inner wall of a water supply pipe 1, the cleaning device comprises a cleaning unit 2 and a control unit 3, the cleaning unit 2 is connected to the control unit 3, at least partially provided inside the water supply pipe 1, and used to remove the foreign body left on the inner wall of the water supply pipe 1; the control unit 3 is used to detect whether volume of the foreign body left on the inner wall of the water supply pipe exceeds a preset volume, when it is determined that the volume of the foreign body left on the inner wall of the water supply pipe exceeds the preset volume, the control unit 3 controls the cleaning unit 2 to clean the water supply pipe so as to remove the foreign body left on the inner wall of the water supply pipe.

In the cleaning device of this embodiment, by providing the cleaning unit and the control unit, the foreign bodies left on the inner wall of the water supply pipe 1 can be removed automatically, thus normal water supply of the water supply pipe 1 can be ensured.

The cleaning device of the present embodiment can remove the foreign bodies left on the inner wall of the water supply pipe for cleaning the glass substrate, thus normal water supply of the water supply pipe 1 during cleaning the glass substrate can be ensured, and therefore, influence on the cleaning of the glass substrate due to abnormal water supply of the water supply pipe can be avoided.

In this embodiment, the cleaning unit 2 comprises a support portion and a cleaning portion, and the support portion includes a support rod 21, the cleaning portion includes a cleaning head 22, a nozzle 23 and a sprinkling pipe 24, wherein the cleaning head 22 is provided inside the water supply pipe 1, the nozzle 23 is provided on the cleaning head 22, one end of the sprinkling pipe 24 is connected to the nozzle 23, and water in the sprinkling pipe 24 can be ejected onto the cleaning head 22 through the nozzle 23; and one end of the support rod 21 is connected to the cleaning head 22 so as to support the cleaning head 22, and the sprinkling pipe 24 is arranged along a length direction of the support rod 21. By means of the above configuration, it can be ensured that the sprinkling pipe 24 may not occupy too much space; in addition, when the cleaning head 22 is removing the foreign bodies left on the inner wall of the water supply pipe 1, the nozzle 23 can eject water to the cleaning head 22 at the same time, so as to flush the removed particles of the foreign bodies out of the water supply pipe 1.

Figure 2:
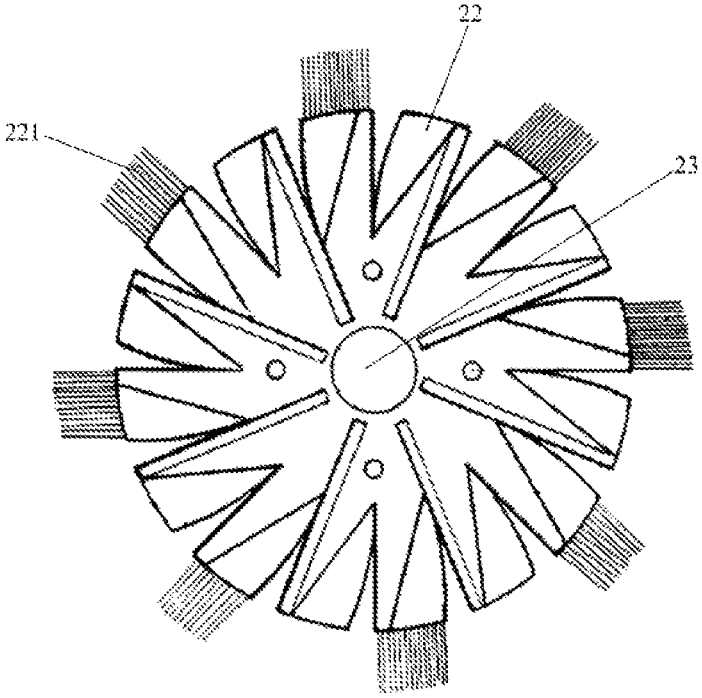
FIG. 2 is a structural top view of a cleaning head of the cleaning device in FIG. 1.

In this embodiment, as shown in FIG. 2, the cleaning head 22 is impeller-shaped, the nozzle 23 is positioned at the center of the cleaning head 22, and water ejected from the nozzle 23 can be ejected onto the blades of the impeller-shaped cleaning head 22 to impel the cleaning head 22 to rotate around its center. The inner wall of the water supply pipe 1 is cleaned by means of the rotation of the cleaning head 22 so that the inner wall of the water supply pipe 1 can be cleaned to be more uniform and clean.

In this embodiment, at least part of the blades of the cleaning head 22 are provided with needle-shaped teeth 221 at end faces thereof, and the needle-shaped teeth 221 can smash the foreign body left on the inner wall of the water supply pipe 1 when the water supply pipe 1 is cleaned. With the rotation of the cleaning head 22, the needle-shaped teeth 221 smash the foreign body left on the inner wall of the water supply pipe 1 to make it drop, and the smashed foreign body is easily discharged from the water supply pipe 1. While only part of the blades of the cleaning head 22 are provided with needle-shaped teeth 221 at end faces thereof as shown in FIG. 2, the present invention is not limited thereto, for example, each of the blades of the cleaning head 22 can be provided with needle-shaped teeth 221 at end face thereof.

In this embodiment, as shown in FIG. 1, the cleaning portion further includes a driving mechanism 25, which is connected to the other end of the sprinkling pipe 24 and is used to inject water into the sprinkling pipe 24 at a set pressure, so that water ejected onto the cleaning head 22 from the nozzle 23 also has a certain pressure, the water with a certain pressure, on one hand, may better impel the blades of the cleaning head 22 so that the entire cleaning head 22 can rotate, and on the other hand, may better flush the particles of the foreign bodies which are smashed and dropped out of the inner wall of the water supply pipe 1. The driving mechanism is, for example, a water pump.

In this embodiment, the support rod 21 can be stretched or contracted. With such a configuration, the cleaning head 22 may be impelled by the stretch and contraction of the support rod 21 to move in an extension direction of the water supply pipe 1, so that the cleaning head 22 can remove the foreign bodies left at various positions on the inner wall of the water supply pipe 1.

In this embodiment, the sprinkling pipe 24 is a flexible pipe. For example, the sprinkling pipe 24 may be a rubber pipe, a metal pipe or a plastic pipe, with this configuration, the sprinkling pipe 24 may easily move in the water supply pipe 1, and is not easily broken during moving.

In this embodiment, the control unit 3 includes a collection portion 31 and a control portion 32, the collection portion 31 is connected to the control portion 32, and the control portion 32 is connected to the driving mechanism 25; the collection portion 31 is used to collect an actual water flow rate and/or an actual water pressure inside the water supply pipe 1, and the control portion 32 is used to judge whether the volume of a foreign body left on the inner wall of the water supply pipe 1 exceeds a preset volume according to the actual water flow rate and/or the actual water pressure, and transmit a cleaning control signal to the driving mechanism when the control portion determines that the volume of the foreign body left on the inner wall of the water supply pipe 1 exceeds the preset volume; and the driving mechanism 25 is used to inject water into the sprinkling pipe 24 under the control of the cleaning control signal when the volume of the foreign body left on the inner wall of the water supply pipe 1 exceeds the preset volume. With the arrangement of the collection portion 31 and the control portion 32, the water supply pipe 1 can be automatically cleaned by the cleaning device, so that the cleaning device is more intelligent and the water supply pipe 1 can be effectively cleaned in time.

Figure 3:
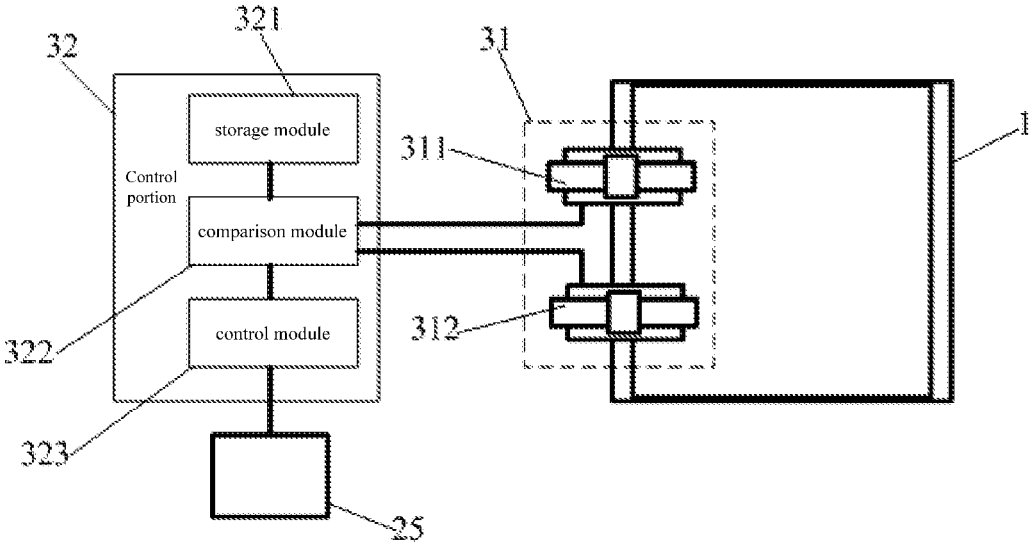
FIG. 3 is a structural principle block diagram of a control unit of the cleaning device in FIG. 1.

In this embodiment, as shown in FIG. 3, the collection portion 31 includes a flow rate sensor 311 and a pressure sensor 312 provided on the wall of the water supply pipe 1, the flow rate sensor 311 is used to collect the actual water flow rate inside the water supply pipe 1, and the pressure sensor 312 is used to collect the actual water pressure inside the water supply pipe 1. Since the water flow rate and the water pressure inside the water supply pipe 1 are proportional to the volume of the foreign bodies left on the inner wall of the water supply pipe 1, whether the volume of a foreign body left on the inner wall of the water supply pipe 1 exceeds the preset volume can be determined according to the actual water flow rate and the actual water pressure inside the water supply pipe 1.

In this embodiment, the control portion 32 includes a storage module 321, a comparison module 322 and a control module 323, the storage module 321 is connected to the comparison module 322, the comparison module 322 is connected to the control module 323, and the control module 323 is connected to the driving mechanism 25; the storage module 321 is used to store a normal water flow rate and a normal water pressure inside the water supply pipe 1; the comparison module 322 is used to compare the actual water flow rate with the normal water flow rate and compare the actual water pressure with the normal water pressure to judge whether the actual water flow rate exceeds the normal water flow rate and the actual water pressure exceeds the normal water pressure, and transmit a judgment result to the control module 323; and the control module 323 is used to control the driving mechanism 25 to inject water into the sprinkling pipe 24 through the cleaning control signal when the actual water flow rate exceeds the normal water flow rate and the actual water pressure exceeds the normal water pressure.

In this embodiment, the normal water flow rate and the normal water pressure indicate the preset volume of the foreign bodies left on the inner wall of the water supply pipe 1, when they are within a preset range corresponding to the preset volume, the water supply pipe 1 can normally supply water. The actual water flow rate and the actual water pressure indicate volume of the foreign bodies left on the inner wall of the water supply pipe 1 which are collected in time. When the actual water flow rate exceeds the normal water flow rate and the actual water pressure exceeds the normal water pressure, it is indicated that the volume of the foreign bodies left on the inner wall of the water supply pipe 1 exceeds the preset volume. When the comparison module 322 determines that the actual water flow rate exceeds the normal water flow rate and the actual water pressure exceeds the normal water pressure, the control module 323 transmits a cleaning control signal to the driving mechanism 25. The driving mechanism 25 injects water into the sprinkling pipe 24 under the control of the cleaning control signal, and the cleaning head 22 starts to rotate by impelling force generated by water ejection of the nozzle 23, so that the inner wall of the water supply pipe 1 is cleaned.

Based on the configuration of the above cleaning device, this embodiment further provides a cleaning method implemented by the above cleaning device, comprising steps of: detecting, by the control unit, whether volume of a foreign body left on an inner wall of the water supply pipe exceeds a preset volume, and if the volume of the foreign body left on the inner wall of the water supply pipe exceeds the preset volume, controlling, by the control unit, the cleaning device to clean the water supply pipe to remove the foreign body left on the inner wall of the water supply pipe; if the volume of the foreign body left on the inner wall of the water supply pipe does not exceed the preset volume, controlling, by the control unit, the cleaning device not to clean the water supply pipe so as not to remove the foreign body left on the inner wall of the water supply pipe.

The step of detecting, by the control unit, whether volume of a foreign body left on an inner wall of the water supply pipe exceeds a preset volume further comprises steps of:

collecting, by the control unit, an actual water flow rate and an actual water pressure inside the water supply pipe; and comparing, by the control unit, the actual water flow rate with a prestored normal water flow rate and the actual water pressure with a prestored normal water pressure to judge whether the actual water flow rate exceeds the normal water flow rate and the actual water pressure exceeds the normal water pressure. In addition, if the actual water flow rate exceeds the normal water flow rate and the actual water pressure exceeds the normal water pressure, the control unit determines that the volume of the foreign body left on the inner wall of the water supply pipe exceeds the preset volume, and controls the cleaning device to clean the water supply pipe to remove the foreign body left on the inner wall of the water supply pipe; if the actual water flow rate does not exceed the normal water flow rate and the actual water pressure does not exceed the normal water pressure, the control unit determines that the volume of the foreign body left on the inner wall of the water supply pipe does not exceed the preset volume, thus the control unit does not control the cleaning device to clean the water supply pipe so as not to remove the foreign body left on the inner wall of the water supply pipe.

Second Embodiment

This embodiment provides a cleaning device, which is different from that in the first embodiment in that: in this embodiment, the collection portion is used to collect an actual water flow rate or an actual water pressure inside the water supply pipe, and the control portion is used to judge whether the volume of a foreign body left on the inner wall of the water supply pipe exceeds a preset volume according to the actual water flow rate or the actual water pressure, and transmit a cleaning control signal to the driving mechanism when the control portion determines that the volume of the foreign body left on the inner wall of the water supply pipe exceeds the preset volume; and the driving mechanism is used to inject water into the sprinkling pipe under the control of the cleaning control signal when the volume of the foreign body left on the inner wall of the water supply pipe exceeds the preset volume.

Accordingly, the collection portion includes a flow rate sensor or a pressure sensor. The comparison module compares the actual water flow rate with the prestored normal water flow rate or compare the actual water pressure with the prestored normal water pressure to judge whether the actual water flow rate exceeds the normal water flow rate or the actual water pressure exceeds the normal water pressure, and transmits a judgment result to the control module. The control module is used to control the driving mechanism to inject water into the sprinkling pipe through the cleaning control signal when the actual water flow rate exceeds the normal water flow rate or the actual water pressure exceeds the normal water pressure.

Since the water flow rate or the water pressure inside the water supply pipe is proportional to the volume of the foreign bodies left on the inner wall of the water supply pipe, whether the volume of a foreign body left on the inner wall of the water supply pipe exceeds the preset volume can be determined according to the actual water flow rate or the actual water pressure inside the water supply pipe. In this embodiment, both the normal water flow rate and the normal water pressure indicate the preset volume of the foreign bodies left on the inner wall of the water supply pipe, if the volume of a foreign body left on the inner wall of the water supply pipe does not exceed the preset volume, the water supply pipe can normally supply water. Both the actual water flow rate and the actual water pressure indicate volume of the foreign bodies left on the inner wall of the water supply pipe which are collected in time. When the actual water flow rate exceeds the normal water flow rate or the actual water pressure exceeds the normal water pressure, it is indicated that the volume of the foreign bodies left on the inner wall of the water supply pipe exceeds the preset volume. When the comparison module determines that the actual water flow rate exceeds the normal water flow rate or the actual water pressure exceeds the normal water pressure, the control module transmits a cleaning control signal to the driving mechanism. The driving mechanism injects water into the sprinkling pipe under the control of the cleaning control signal, and the cleaning head starts to rotate by impelling force generated by water ejection of the nozzle, so that the inner wall of the water supply pipe is cleaned to remove the foreign bodies left on the inner wall of the water supply pipe.

Other structures of the cleaning device in this embodiment are the same as those in the first embodiment, and will not be repeated herein.

Based on the configuration of the above cleaning device, this embodiment further provides a cleaning method implemented by the above cleaning device, which is different from the cleaning method in the first embodiment in that: the step of detecting, by the control unit, whether volume of a foreign body left on an inner wall of the water supply pipe exceeds a preset volume further comprises steps of:

collecting, by the control unit, an actual water flow rate or an actual water pressure inside the water supply pipe; and comparing, by the control unit, the actual water flow rate with a prestored normal water flow rate or the actual water pressure with a prestored normal water pressure to judge whether the actual water flow rate exceeds the normal water flow rate or the actual water pressure exceeds the normal water pressure. In addition, if the actual water flow rate exceeds the normal water flow rate or the actual water pressure exceeds the normal water pressure, the control unit determines that the volume of the foreign body left on the inner wall of the water supply pipe exceeds the preset volume, and controls the cleaning device to clean the water supply pipe to remove the foreign body left on the inner wall of the water supply pipe; if the actual water flow rate does not exceed the normal water flow rate or the actual water pressure does not exceed the normal water pressure, the control unit determines that the volume of the foreign body left on the inner wall of the water supply pipe does not exceed the preset volume, thus the control unit does not control the cleaning device to clean the water supply pipe so as not to remove the foreign body left on the inner wall of the water supply pipe.

Other steps of the cleaning method implemented by the cleaning device in this embodiment are the same as those in the first embodiment, and will not be repeated herein.

Advantages of the first and second embodiments are as follows: in the cleaning devices of these embodiments, by providing the cleaning unit and the control unit, the foreign bodies left on the inner wall of the water supply pipe can be removed automatically, thus normal water supply of the water supply pipe can be ensured.

It should be understood that, the above embodiments are only exemplary embodiments used to explain the principle of the present invention and the protection scope of the present invention is not limited thereto. The person skilled in the art can make various variations and modifications without departing from the spirit and scope of the present invention, and these variations and modifications should be considered to belong to the protection scope of the invention.

The invention claimed is:

1. A cleaning device for cleaning a water supply pipe, comprising:

a cleaning unit, which is at least partially provided inside the water supply pipe; and a control unit, which is connected to the cleaning unit, for detecting whether volume of a foreign body left on an inner wall of the water supply pipe exceeds a preset volume, and when it is determined that the volume of the foreign body left on the inner wall of the water supply pipe exceeds the preset volume, controlling the cleaning unit to clean the water supply pipe so as to remove the foreign body left on the inner wall of the water supply pipe, wherein the cleaning unit comprises a support portion including a support rod, and a cleaning portion including a cleaning head, a nozzle and a sprinkling pipe, the cleaning head is provided inside the water supply pipe, the nozzle is provided on the cleaning head, one end of the sprinkling pipe is connected to the nozzle, water in the sprinkling pipe can be ejected onto the cleaning head through the nozzle, one end of the support rod is connected to the cleaning head so as to support the cleaning head, and the sprinkling pipe is arranged along a length direction of the support rod, wherein the cleaning head is impeller-shaped, the nozzle is positioned at the center of the cleaning head, and water ejected from the nozzle can be directly ejected onto blades of the impeller-shaped cleaning head to impel the cleaning head to rotate around its center, and wherein at least part of the blades of the cleaning head are provided with needle-shaped teeth at end faces thereof, and wherein the needle-shaped teeth can smash the foreign body left on the inner wall of the water supply pipe.

2. The cleaning device of claim 1, wherein the cleaning portion further includes a driving mechanism, which is connected to the other end of the sprinkling pipe for injecting water into the sprinkling pipe at a set pressure.

3. The cleaning device of claim 2, wherein the control unit includes a collection portion and a control portion, the collection portion is connected to the control portion, and the control portion is connected to the driving mechanism; the collection portion is used to collect an actual water flow rate and/or an actual water pressure inside the water supply pipe, and the control portion is used to judge whether the volume of the foreign body left on the inner wall of the water supply pipe exceeds the preset volume according to the actual water flow rate and/or the actual water pressure, and transmit a cleaning control signal to the driving mechanism when the control portion determines that the volume of the foreign body left on the inner wall of the water supply pipe exceeds the preset volume; and the driving mechanism is used to inject water into the sprinkling pipe under the control of the cleaning control signal.

4. The cleaning device of claim 3, wherein the collection portion includes a flow rate sensor and/or a pressure sensor provided on the wall of the water supply pipe, and wherein the flow rate sensor is used to collect the actual water flow rate inside the water supply pipe, and the pressure sensor is used to collect the actual water pressure inside the water supply pipe.

5. The cleaning device of claim 4, wherein the control portion includes a storage module, a comparison module and a control module, and wherein the storage module is connected to the comparison module, the comparison module is connected to the control module, and the control module is connected to the driving mechanism;

the storage module is used to store a normal water flow rate and a normal water pressure inside the water supply pipe;

the comparison module is used to compare the actual water flow rate with the normal water flow rate and/or compare the actual water pressure with the normal water pressure to judge whether the actual water flow rate exceeds the normal water flow rate and/or the actual water pressure exceeds the normal water pressure, and transmit a judgment result to the control module; and the control module is used to control the driving mechanism to inject water into the sprinkling pipe through the cleaning control signal when the actual water flow rate exceeds the normal water flow rate and/or the actual water pressure exceeds the normal water pressure.

6. The cleaning device of claim 1, wherein the support rod can be stretched or contracted.

7. The cleaning device of claim 1, wherein the sprinkling pipe is a flexible pipe.

8. A cleaning method implemented by the cleaning device of claim 1, comprising steps of:

detecting, by the control unit, whether volume of a foreign body left on an inner wall of the water supply pipe exceeds a preset volume; and cleaning the water supply pipe so as to remove the foreign body left on the inner wall of the water supply pipe, by the cleaning device under the control of the control unit, when the control unit determines that the volume of the foreign body left on an inner wall of the water supply pipe exceeds the preset volume.

9. The cleaning method of claim 8, wherein the step of detecting, by the control unit, whether volume of a foreign body left on an inner wall of the water supply pipe exceeds a preset volume further comprises steps of:

collecting, by the control unit, an actual water flow rate and an actual water pressure inside the water supply pipe; and comparing, by the control unit, the actual water flow rate with a prestored normal water flow rate and the actual water pressure with a prestored normal water pressure to judge whether the actual water flow rate exceeds the normal water flow rate and the actual water pressure exceeds the normal water pressure, wherein, if the actual water flow rate exceeds the normal water flow rate and the actual water pressure exceeds the normal water pressure, the control unit determines that the volume of the foreign body left on the inner wall of the water supply pipe exceeds the preset volume.

10. The cleaning method of claim 8, wherein the step of detecting, by the control unit, whether volume of a foreign body left on an inner wall of the water supply pipe exceeds a preset volume further comprises steps of:

collecting, by the control unit, an actual water flow rate inside the water supply pipe; and comparing, by the control unit, the actual water flow rate with a prestored normal water flow rate to judge whether the actual water flow rate exceeds the normal water flow rate, wherein, if the actual water flow rate exceeds the normal water flow rate, the control unit determines that the volume of the foreign body left on the inner wall of the water supply pipe exceeds the preset volume.

11. The cleaning method of claim 8, wherein the step of detecting, by the control unit, whether volume of a foreign body left on an inner wall of the water supply pipe exceeds a preset volume further comprises steps of:

collecting, by the control unit, an actual water pressure inside the water supply pipe; and comparing, by the control unit, the actual water pressure with a prestored normal water pressure to judge whether the actual water pressure exceeds the normal water pressure, wherein, if the actual water pressure exceeds the normal water pressure, the control unit determines that the volume of the foreign body left on the inner wall of the water supply pipe exceeds the preset volume.

* * * * *